US006542051B1

(12) United States Patent
Nakada

(10) Patent No.: US 6,542,051 B1
(45) Date of Patent: Apr. 1, 2003

(54) STUB SWITCHED PHASE SHIFTER

(75) Inventor: Kuniyoshi Nakada, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/695,879

(22) Filed: Oct. 26, 2000

(30) Foreign Application Priority Data

Oct. 29, 1999 (JP) ..... 11-308853

(51) Int. Cl.[7] ..... H01P 9/00
(52) U.S. Cl. ..... 333/164; 333/101
(58) Field of Search ..... 333/164, 101, 333/139

(56) References Cited

U.S. PATENT DOCUMENTS

| | | | | |
|---|---|---|---|---|
| 3,131,367 A | | 4/1964 | Pitts et al. | 333/164 |
| 3,568,105 A | * | 3/1971 | Felsenheld | 333/161 |
| 5,166,648 A | * | 11/1992 | Wen et al. | 333/139 |

FOREIGN PATENT DOCUMENTS

| | | |
|---|---|---|
| JP | 58-3339 | 1/1983 |
| JP | 59-196603 | 11/1984 |
| JP | 4-32301 | 2/1992 |
| JP | 5-251903 | 9/1993 |

OTHER PUBLICATIONS

Japanese Office Action dated Jun. 4, 2002, with partial English translation.

* cited by examiner

*Primary Examiner*—Robert Pascal
*Assistant Examiner*—Joseph Chang
(74) *Attorney, Agent, or Firm*—McGinn & Gibb, PLLC

(57) ABSTRACT

In a phase shifter for digitally shifting the phase of an RF (Radio Frequency) signal by changing a switched line which is connecting two main lines into another switched line, at least one of the switched lines is always connected to one of the main lines so as to operate as an open stub when the RF signal is not passed through the switched line. A concrete example of the phase shifter includes a first main line, a second main line which is placed a predetermined distance apart from the first main line, a first switched line which is placed between the first main line and the second main line, a second switched line which is placed between the first main line and the second main line and which is always connected to the second main line, a first switch for controlling the connection/disconnection between the first main line and the first switched line, a second switch for controlling the connection/disconnection between the second main line and the first switched line, and a third switch for controlling the connection/disconnection between the first main line and the second switched line. The second switched line operates as the open stub when the RF signal is not passed through it, thereby phase shift deviation is reduced and phase shift-frequency relationship is improved. In addition, the number of switches can be reduced in comparison with a conventional switched line phase shifter.

12 Claims, 12 Drawing Sheets

STUB SWITCHED PHASE SHIFTER

BACKGROUND OF THE INVENTION

The present invention relates to a phase shifter, and in particular, to a phase shifter for a microwave or millimeter wave band which is used as part of a phase control element of a phased array antenna etc.

DESCRIPTION OF THE RELATED ART

A typical conventional switched line phase shifter is composed of two main lines, two or more switched lines (a reference line and one or more delay lines), and two or more RF (Radio Frequency) switches. Each end of a switched line is connected to one of the main lines through an RF switch. By the operation of the RF switches, the connection between the two main lines changes and thereby a desired phase shift is given to an RF signal which is passing through the phase shifter.

FIG. 1 is a circuit diagram showing a conventional switched line phase shifter. Referring to FIG. 1, the conventional switched line phase shifter includes two switched lines S and L and four RF switches SWa~SWd. Each switched line (S, L) is connected between two main lines $ML_1$and $ML_2$, and each RF switch (SWa, SWb, SWc, SWd) is connected between a main line and a switched line. The length of the switched line L is set longer than that of the switched line S. The connection between the main lines $ML_1$ and $ML_2$ through the switched line S or L is changed by the operation of the RF switches SWa~SWd. When the RF switches SWa~SWd, which operate together, are (OFF, OFF, ON, ON), the switched line L is connected with the main lines $ML_1$ and $ML_2$ and the switched line S is disconnected from the main lines $ML_1$ and $ML_2$ (hereafter referred to as "state L"). When the RF switches SWa~SWd are (ON, ON, OFF, OFF), the switched line S is connected with the main lines $ML_1$ and $ML_2$ and the switched line L is disconnected from the main lines $ML_1$ and $ML_2$ (hereafter referred to as "state S"). By the switching of the RF switches SWa~SWd between the states L and S, a phase shift corresponding to the length difference between the switched lines L and S is realized.

However, in the conventional switched line phase shifter which has been described above, phase shift deviation (deviation of phase shift when the frequency of an input RF signal varies) occurs as will be described below.

FIG. 2 is a plan view showing a conventional 90° switched line phase shifter which is composed of microstrip lines, and FIG. 3 is an explanatory drawing which explains the operation of the conventional 90° switched line phase shifter of FIG. 2 simply. FIGS. 2 and 3 are equivalent in electrical meanings. Referring to FIGS. 2 and 3, the lengths of the switched lines L and S are $L=\lambda g_0/2$ and $S=\lambda g_0/4$, therefore, the designed phase shift of the 90° switched line phase shifter becomes ΔΦ 90° corresponding to the length difference ($L-S=\lambda g_0/4$) between the switched lines L and S.

FIG. 4 is a graph showing the phase shift deviation (phase shift-frequency relationship) of the conventional 90° switched line phase shifter of FIGS. 2 and 3 (simulation result). In FIG. 4, the vertical axis denotes phase shift of the 90° switched line phase shifter in the state S relative to the state L (ΔΦ=ΦS−Φ)L (ΦS:transmission phase delay in the state S, ΦL: transmission phase delay in the state L)). Incidentally, a transmission phase delay of ¼ $\lambda g_0$ is usually expressed as −90° (negative), for example. The lengths (L, S) of the switched lines L and S are set based on the wavelength $\lambda g_0$ at the (designed) center frequency $f_0$. For example, in the case of FIG. 3, the switched line lengths L and S are set so that L−S will be $\lambda g_0/4$ ($L=\lambda g/2$, $S=\lambda g_0/4$), thereby the phase difference between the states L and S becomes ΔΦ32 90° at the center frequency $f_0$.

However, in the frequency range higher than the center frequency $f_0$, the wavelength is shorter than $\lambda g_0$ and thus the phase shift becomes larger than 90°0 . On the other hand, in the lower frequency range, the wavelength is longer than $\lambda g_0$ and thus the phase shift becomes smaller than 90° . Consequently, the phase shift-frequency relationship of the 90° switched line phase shifter becomes a straight line having a positive slope as shown in FIG. 4. In the case of FIG. 4, the phase shift ΔΦ is precisely 90° at the center frequency $f_0$, however, the phase shift ΔΦ deviates from 90° and the phase shift deviation becomes larger as the frequency of the input RF signal deviates from the center frequency $f_0$.

Further, in the conventional switched line phase shifter which has been shown in FIGS. 1 through 3, four RF switches are necessary for switching the connections of the two switched lines L and S of different lengths and thereby obtaining the phase shift ΔΦ. The number 4 of the RF switches is larger in comparison with other types of phase shifters. For example, a loaded line phase shifter can be implemented by only two RF switches.

SUMMARY OF THE INVENTION

It is therefore the primary object of the present invention to provide a phase shifter that can reduce the phase shift deviation and thereby enlarge the usable frequency range.

Another object of the present invention is to provide a phase shifter that can be implemented by a smaller number of RF switches.

In accordance with a first aspect of the present invention, there is provided a phase shifter for digitally shifting the phase of an RF (Radio Frequency) signal by changing a switched line which is connecting two main lines into another switched line. In the phase shifter, at least one of the switched lines is always connected to one of the main lines so as to operate as an open stub when the RF signal is not passed through the switched line.

In accordance with a second aspect of the present invention, in the first aspect, the phase shifter comprises a first main line, a second main line which is placed a predetermined distance apart from the first main line, a first switched line which is placed between the first main line and the second main line, a second switched line which is placed between the first main line and the second main line and which is always connected to the second main line, a first switch for controlling the connection/disconnection between the first main line and the first switched line, a second switch for controlling the connection/disconnection between the second main line and the first switched line, and a third switch for controlling the connection/disconnection between the first main line and the second switched line.

In accordance with a third aspect of the present invention, in the second aspect, the length of the first switched line is set to ¼ of the wavelength of the RF signal and the length of the second switched line is set to ½ of the wavelength and thereby a 90° phase shifter is implemented.

In accordance with a fourth aspect of the present invention, in the second aspect, the length of the first switched line is set to ½ of the wavelength of the RF signal and the length of the second switched line is set to the wavelength and thereby a 180° phase shifter is implemented.

In accordance with a fifth aspect of the present invention, in the second aspect, the first main line, the second main line, the first switched line and the second switched line are implemented by microstrip lines.

In accordance with a sixth aspect of the present invention, in the second aspect, the first main line, the second main line, the first switched line and the second switched line are implemented by slot lines.

In accordance with a seventh aspect of the present invention, in the second aspect, the first main line, the second main line, the first switched line and the second switched line are implemented by co-planer lines.

In accordance with an eighth aspect of the present invention, in the second aspect, the first main line, the second main line, the first switched line and the second switched line are implemented by coaxial lines.

In accordance with a ninth aspect of the present invention, in the second aspect, the first switch, the second switch and the third switch are implemented by PIN diodes.

In accordance with a tenth aspect of the present invention, in the second aspect, the first switch, the second switch and the third switch are implemented by FETs (Field-Effect Transistors).

In accordance with an eleventh aspect of the present invention, in the second aspect, the first switch, the second switch and the third switch are implemented by mechanical relays.

In accordance with a twelfth aspect of the present invention, in the second aspect, the first switch, the second switch and the third switch are implemented by micromachine switches.

In accordance with a thirteenth aspect of the present invention, in the second aspect, the first switch, the second switch and/or the third switch are installed in positions which are withdrawn from the main lines.

In accordance with a fourteenth aspect of the present invention, in the first aspect, the phase shifter comprises a first main line, a second main line which is placed a predetermined distance apart from the first main line, a switched line which is placed between the first main line and the second main line and which is always connected to the second main line, a first switch for controlling the connection/disconnection between the first main line and the second main line, and a second switch for controlling the connection/disconnection between the first main line and the switched line.

In accordance with a fifteenth aspect of the present invention, in the fourteenth aspect, the length of the switched line is set to ½ of the wavelength of the RF signal and thereby a 180° phase shifter is implemented.

In accordance with a sixteenth aspect of the present invention, in the fourteenth aspect, the first main line, the second main line and the switched line are implemented by microstrip lines.

In accordance with a seventeenth aspect of the present invention, in the fourteenth aspect, the first main line, the second main line and the switched line are implemented by slot lines.

In accordance with an eighteenth aspect of the present invention, in the fourteenth aspect, the first main line, the second main line and the switched line are implemented by co-planer lines.

In accordance with a nineteenth aspect of the present invention, in the fourteenth aspect, the first main line, the second main line and the switched line are implemented by coaxial lines.

In accordance with a twentieth aspect of the present invention, in the fourteenth aspect, the first switch and the second switch are implemented by PIN diodes.

In accordance with a twenty-first aspect of the present invention, in the fourteenth aspect, the first switch and the second switch are implemented by FETs (Field-Effect Transistors).

In accordance with a twenty-second aspect of the present invention, in the fourteenth aspect, the first switch and the second switch are implemented by mechanical relays.

In accordance with a twenty-third aspect of the present invention, in the fourteenth aspect, the first switch and the second switch are implemented by micromachine switches.

In accordance with a twenty-fourth aspect of the present invention, in the fourteenth aspect, the first switch and/or the second switch are installed in positions which are withdrawn from the main lines.

In accordance with a twenty-fifth aspect of the present invention, in the first aspect, the phase shifter comprises a first main line, a second main line which is placed a predetermined distance apart from the first main line, a first switched line which is placed between the first main line and the second main line, a second switched line which is always connected to the first main line, a third switched line which is placed between the second switched line and the second main line and which is always connected to the second main line, a first switch for controlling the connection/disconnection between the first main line and the first switched line, a second switch for controlling the connection/disconnection between the second main line and the first switched line, and a third switch for controlling the connection/disconnection between the first switched line and the second switched line.

In accordance with a twenty-sixth aspect of the present invention, in the twenty-fifth aspect, the length of the first switched line is set to ¾ of the wavelength of the RF signal and the lengths of the second switched line and the third switched line are set to ½ of the wavelength and thereby a 90° phase shifter is implemented.

In accordance with a twenty-seventh aspect of the present invention, in the twenty-fifth aspect, the lengths of the first switched line, the second switched line and the third switched line are set to ½ of the wavelength of the RF signal and thereby a 180° phase shifter is implemented.

In accordance with a twenty-eighth aspect of the present invention, in the twenty-fifth aspect, the first main line, the second main line, the first switched line, the second switched line and the third switched line are implemented by microstrip lines.

In accordance with a twenty-ninth aspect of the present invention, in the twenty-fifth aspect, the first main line, the second main line, the first switched line, the second switched line and the third switched line are implemented by slot lines.

In accordance with a thirtieth aspect of the present invention, in the twenty-fifth aspect, the first main line, the second main line, the first switched line, the second switched line and the third switched line are implemented by co-planer lines.

In accordance with a thirty-first aspect of the present invention, in the twenty-fifth aspect, the first main line, the second main line, the first switched line, the second switched line and the third switched line are implemented by coaxial lines.

In accordance with a thirty-second aspect of the present invention, in the twenty-fifth aspect, the first switch, the second switch and the third switch are implemented by PIN diodes.

In accordance with a thirty-third aspect of the present invention, in the twenty-fifth aspect, the first switch, the second switch and the third switch are implemented by FETs (Field-Effect Transistors).

In accordance with a thirty-fourth aspect of the present invention, in the twenty-fifth aspect, the first switch, the second switch and the third switch are implemented by mechanical relays.

In accordance with a thirty-fifth aspect of the present invention, in the twenty-fifth aspect, the first switch, the second switch and the third switch are implemented by micromachine switches.

In accordance with a thirty-sixth aspect of the present invention, in the twenty-fifth aspect, the first switch and/or the second switch are installed in positions which are withdrawn from the main lines.

BRIEF DESCRIPTION OF THE DRAWINGS

The objects and features of the present invention will become more apparent from the consideration of the following detailed description taken in conjunction with the accompanying drawings, in which:

FIGS. 7 and 8 are graphs showing the change of transmission phase delay due to the addition of a reactance X (due to the addition of an open stub), in which FIG. 7 shows cases where the open stub length θ is $0.08\ \lambda g_0$~$0.19\lambda g_0$ and FIG. 8 shows cases where the open stub length θ is $\lambda g_0/2$ and $\lambda g_0$;

DESCRIPTION OF THE PREFERRED EMBODIMENTS

Figure 1:
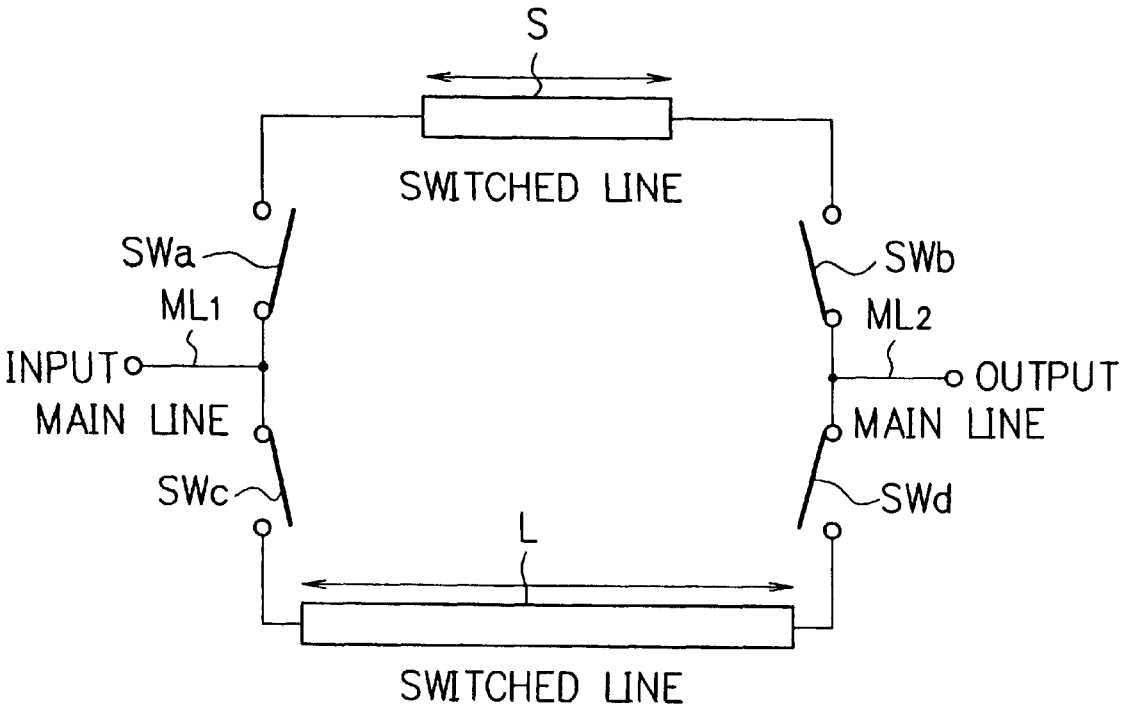
FIG. 1 (PRIOR ART)
FIG. 1 is a circuit diagram showing a conventional switched line phase shifter.
Figure 2:
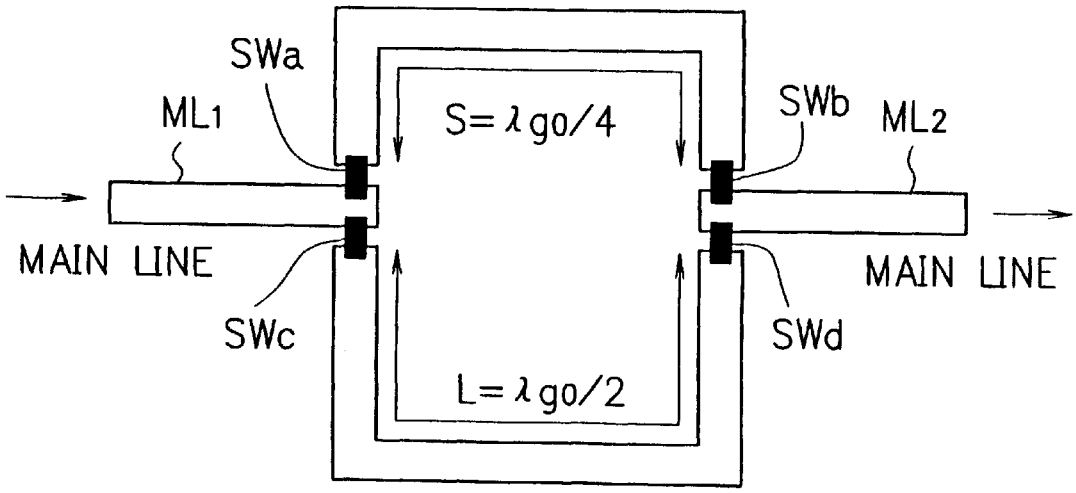
FIG. 2 (PRIOR ART)
FIG. 2 is a plan view showing a conventional 90° switched line phase shifter which is composed of microstrip lines.
Figure 3:
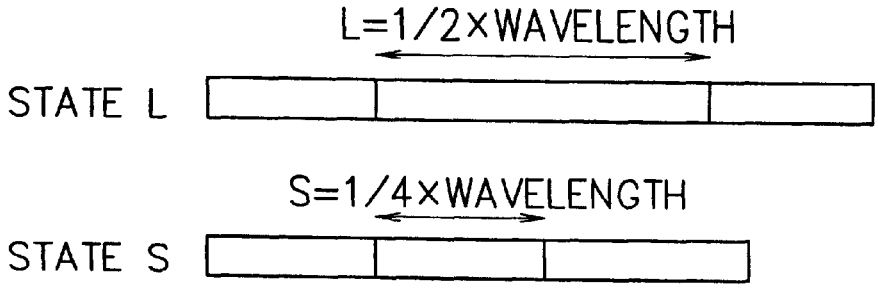
FIG. 3 (PRIOR ART)
FIG. 3 is an explanatory drawing which explains the operation of the conventional 90° switched line phase shifter of FIG. 2 simply.

Referring now to the drawings, a description will be given in detail of preferred embodiments in accordance with the present invention.

Figure 5:
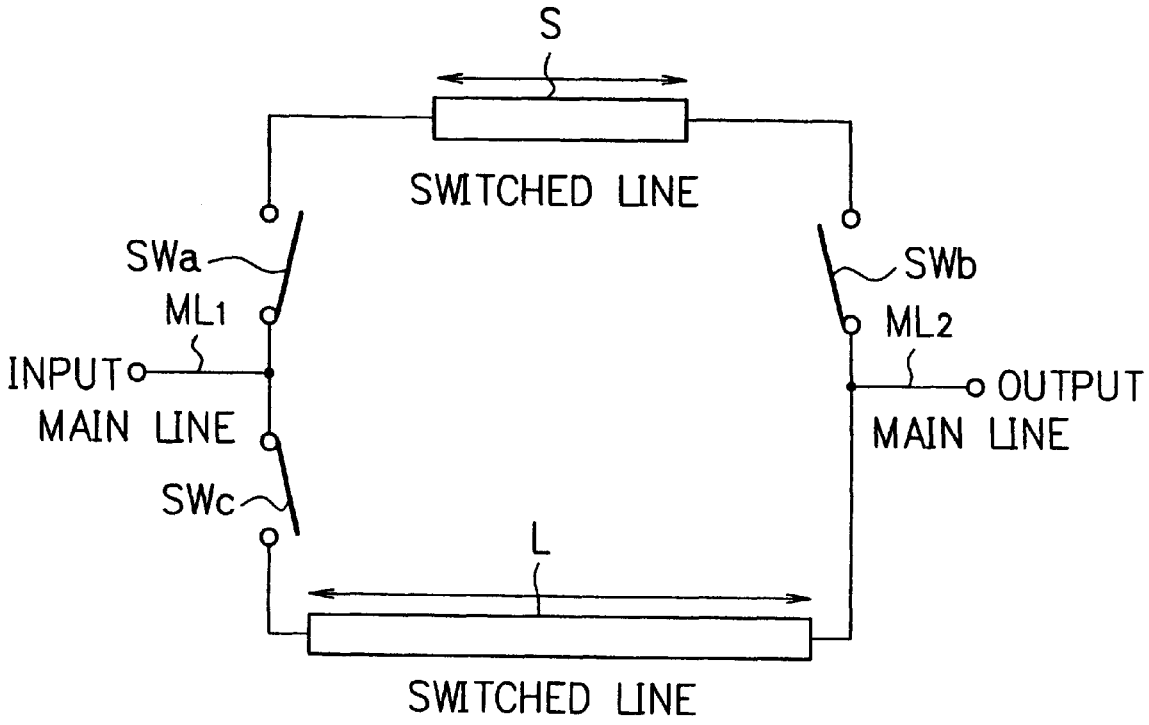
FIG. 5 is a circuit diagram showing a phase shifter in accordance with a first embodiment of the present invention.

FIG. 5 is a circuit diagram showing a phase shifter in accordance with a first embodiment of the present invention. As shown in FIG. 5, in phase shifters in accordance with the present invention, at least one of the switched lines of the conventional switched line phase shifter is always connected to a main line and the switched line operates as an open stub when the input RF signal is not passed through the switched line, thereby the phase shifter deviation is reduced and the phase shift-frequency relationship is improved. effects of the constant connection of the switched line (open stub) to the main line on reflection loss characteristics and transmission loss characteristics are eliminated by setting the length of the switched line connected to the main line at $n\times\lambda/2$ (n:integer, λ:wavelength of the input RF signal). In addition to the aforementioned effects, the number of RF switches is reduced in the phase shifter of the present invention by 1 or 2 in comparison with the conventional switched line phase shifter.

Referring to FIG. 5, the phase shifter of the first embodiment includes two main lines $ML_1$ and $ML_2$, two switched lines S and L, and three RF switches SWa~SWc. An end of the switched line L (long line, delay line) is directly connected to the main line $ML_2$, and the other end of the switched line L is connected to the main line $ML_1$ via the RF switch SWc. The ends of the switched line S (short line, reference line) are connected to the main lines $ML_1$ and $ML_2$ via the RF switches SWa and SWb.

The phase shifter shown in FIG. 5 is implemented by two switched lines and three RF switches, therefore, the number of the switches can be reduced by one in comparison with the conventional switched line phase shifter which has been shown in FIG. 1. The main lines $ML_1$ and $ML_2$ and the switched lines S and L of the phase shifter of FIG. 5 can be implemented by arbitrary types of lines such as microstrip lines, slot lines, co-planer lines (CPWs (Co-Planer Waveguides)), coaxial lines, etc. As the RF switches SWa~SWc, arbitrary types of switches such as PIN diodes, FETs (Field-Effect Transistors), mechanical relays, micromachine switches, etc. can be used.

The RF switches SWa~SWc operate together similarly to the RF switches SWa~SWd of the conventional switched line phase shifter. When the RF switches SWa~SWc are (OFF, OFF, ON), the switched line L is connected to the main line $ML_1$ (and the main line $ML_2$) and the switched line S is disconnected from the main lines $ML_1$ and $ML_2$ (hereafter referred to as "state L"). When the RF switches SWa~SWc are (ON, ON, OFF), the switched line S is connected with the main lines $ML_1$ and $ML_2$ (hereafter referred to as "state S"). Even in the state S, the right-hand end of the switched line L is still connected to the main line $ML_2$, which is characteristic of the phase shifter of the present invention. In the state S, the switched line L operates as an open stub and thereby the phase shift-frequency relationship is improved.

Figure 6:
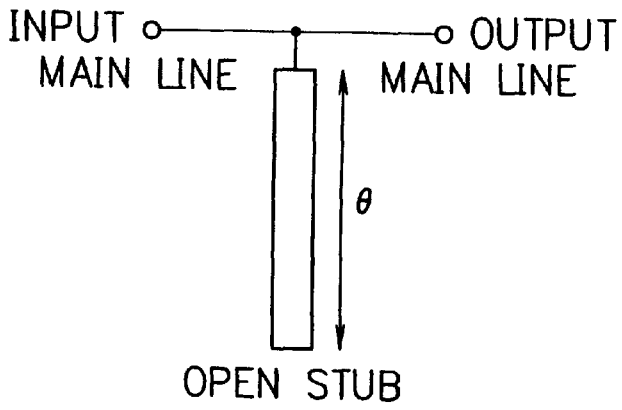
FIG. 6 is a circuit diagram showing an example of a transmission line to which an open stub is added.

By the switching of the RF switches SWa~SWc between the states L and S, a phase shift corresponding to the length difference between the switched lines L and S is realized. The amount of the phase shift $\lambda\Phi$ can be selected arbitrarily by appropriately setting the switched line lengths L and S. In the first embodiment, the switched line lengths L and S are set as $L=\lambda g_0/2$ and $S=\lambda g_0/4$ ($\lambda g_0$:guided wavelength at the designed center frequency $f_0$) and thereby the phase shift $\Delta\Phi$ is set as $\Delta\Phi=90°$ FIG. 6 is a circuit diagram showing an example of a transmission line to which an open stub is added. The reactance X of the open stub is expressed as:

$$X=-Zs\cot(2\pi\theta/\lambda g)$$

where Zs denotes characteristic impedance of the stub, $\theta$ denotes the open stub length and $\lambda g$ denotes the guided wavelength on the transmission line.

Figure 7:
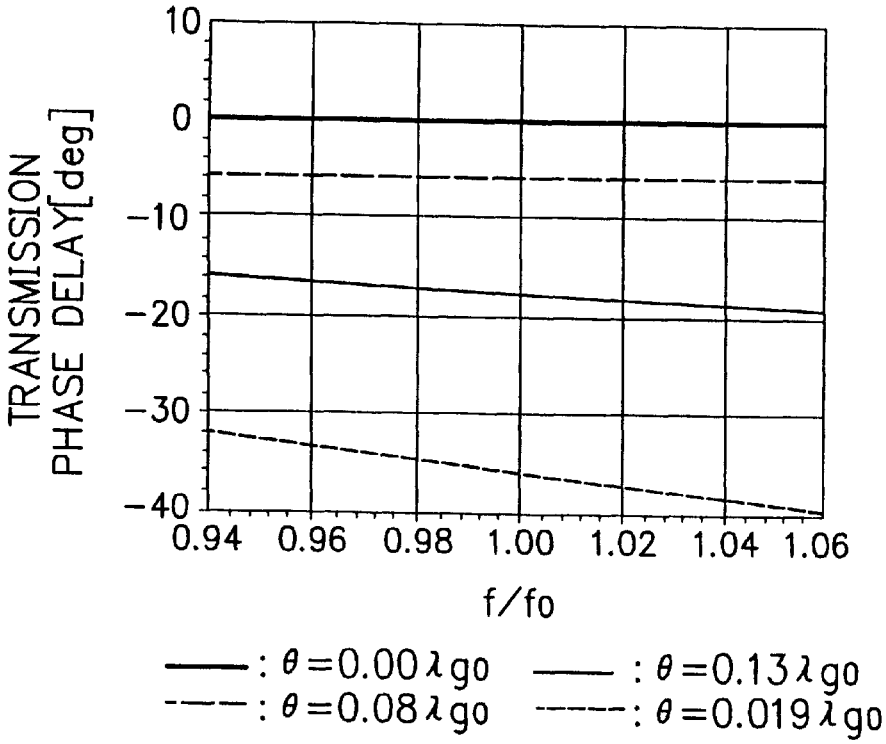
Figure 8:
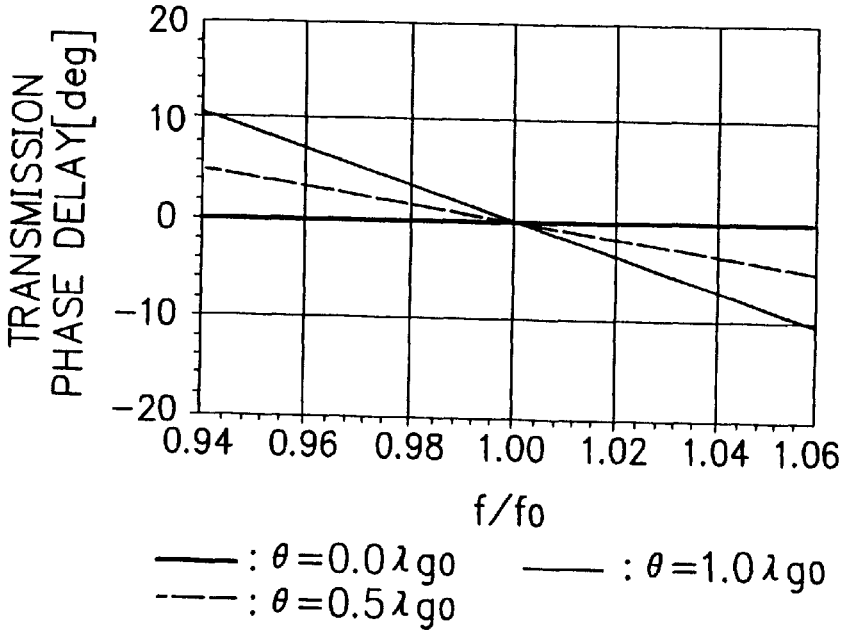

FIGS. 7 and 8 are graphs showing the change of the transmission phase delay due to the addition of the reactance X (due to the addition of the open stub), in which FIG. 7 shows cases where the open stub length $\theta$ is $0.08\ \lambda g_0$–$0.19\ \lambda g_0$ and FIG. 8 shows cases where the open stub length $\theta$ is $\lambda g_0/2$ and $\lambda g_0$. As shown in FIGS. 7 and 8, the transmission phase delay has a negative slope with respect to the input signal frequency f, and the absolute value of the slope gets larger as the open stub length $\theta$ gets larger. As will be mentioned below, in the phase shifter of the first embodiment, the aforementioned phase shift-frequency relationship (positive slope) of the conventional phase shifter is compensated and corrected by the negative slope due to the open stub. Incidentally, when an open stub is added to the transmission line, transmission phase delay generally deviates from 0° throughout the band (frequency range) as shown in FIG. 7, and (although not shown,) mismatch occurs and thereby reflection characteristics are deteriorated. However, such problems can easily be resolved by conducting the designing of the phase shifter taking the transmission phase delay change into consideration and by adding a necessary matching circuit. Or, if the open stub length 0 is selected as $n\times\lambda g_0/2$ (n:integer) as shown in FIG. 8, the transmission phase delay becomes 0° at the center frequency $f_0$, thereby the need for considering the transmission phase delay change is eliminated and (although not shown,) the mismatch problem is resolved.

As explained above, by the connection of the open stub in the state S only, the positive slope of the phase shift-frequency relationship of the conventional phase shifter is compensated by the negative slope due to the addition of the open stub, thereby the phase shift-frequency relationship is made leveler and thereby the usable bandwidth (frequency range) of the phase shifter can be widened. Therefore, if an end of the switched line L is directly connected to a main line as in the phase shifter of the first embodiment shown in FIG. 5, the switched line L operates as an open stub in the state S and thereby the above effects can be obtained.

In the following, the phase shifter of the first embodiment of the present invention will be explained in detail, in which the phase shifter is assumed to be composed of microstrip lines, for example. The following explanation will be given ignoring the effects of curvature of the transmission lines, coupling between the transmission lines, the RF switches, etc.

Figure 9:
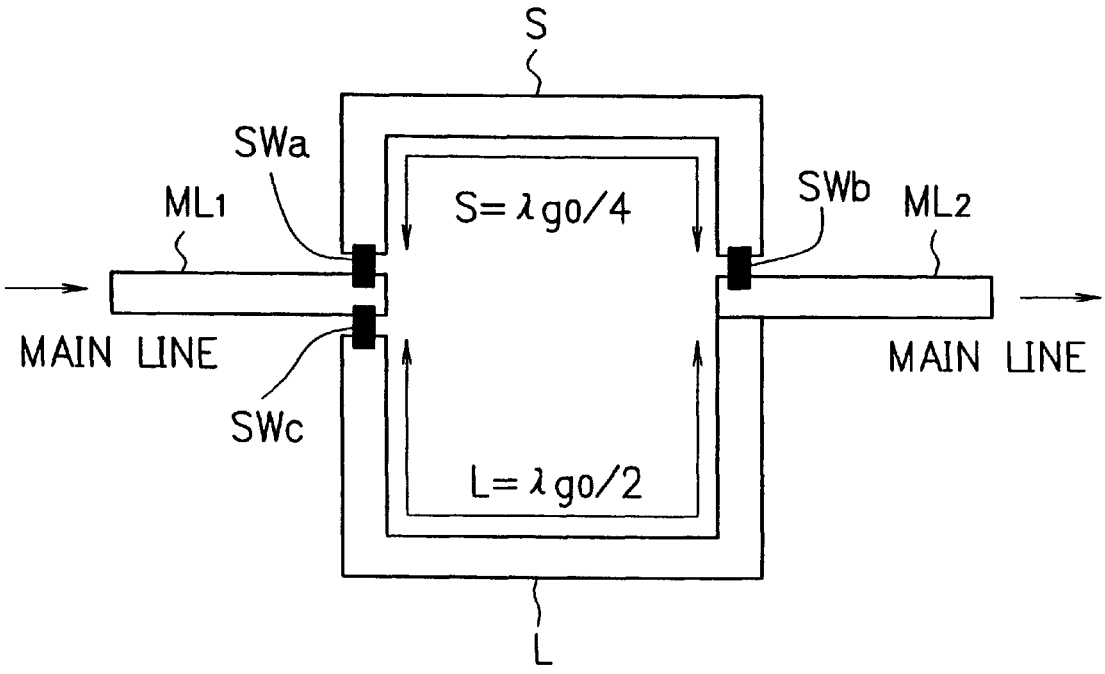
FIG. 9 is a plan view showing a 90° phase shifter in accordance with the first embodiment of the present invention which is composed of microstrip lines.
Figure 10:
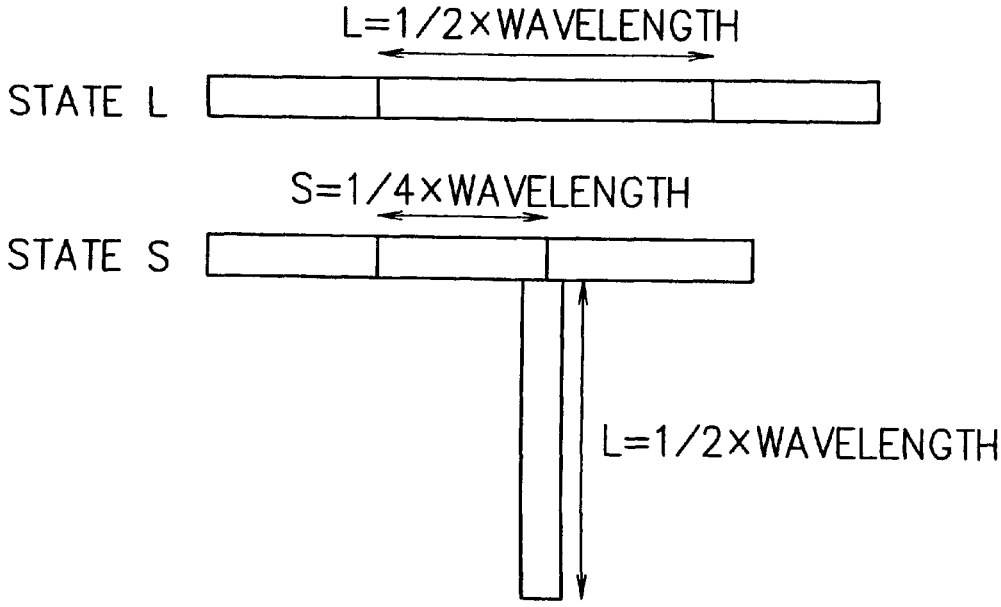
FIG. 10 is an explanatory drawing which explains the operation of the 90° phase shifter of FIG. 9 simply.

FIG. 9 is a plan view showing a 90° phase shifter in accordance with the first embodiment of the present invention which is composed of microstrip lines. FIG. 10 is an explanatory drawing which explains the operation of the 90° phase shifter of FIG. 9 simply. FIGS. 9 and 10 are equivalent in electrical meanings. Referring to FIGS. 9 and 10, the lengths of the switched lines L and S are set as $L=\lambda g_0/2$ and $S=\lambda g_0/4$ and thereby a 90° phase shifter is implemented. The switched line L ($L=\lambda g_0/2$) is connected to the main line $ML_2$ as the open stub in the state S only. The open stub length, that is, the length of switched line L as the open stub which is connected to the main line $ML_2$ is a multiple of $\lambda g_0/2$ (i.e. $n\times\lambda g_0/2$ (n:integer)), thereby the ill effects of the connection of the open stub on the transmission phase delay and matching are avoided. By the addition of the open stub, the positive slope of the phase shift-frequency relationship of the conventional switched line phase shifter is compensated by the negative slope due to the open stub and thereby the phase shift-frequency relationship is improved.

Figure 11:
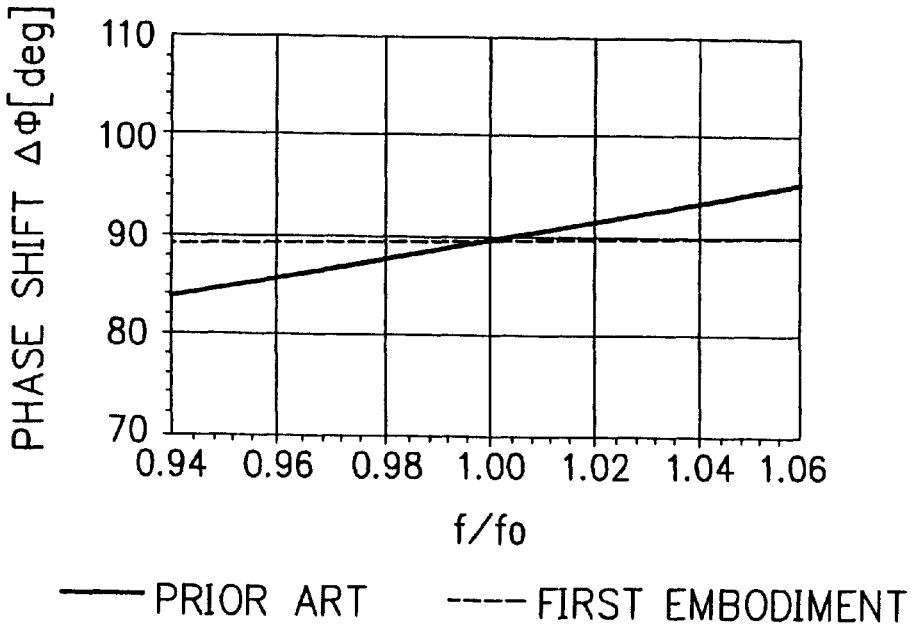
FIG. 11 is a graph showing a simulation result of the phase shift-frequency relationship of the 90° phase shifter of FIGS. 9 and 10.

FIG. 11 is a graph showing a simulation result of the phase shift-frequency relationship of the 90° phase shifter of FIGS. 9 and 10, in which the result for the conventional switched line phase shifter is also shown. As shown in FIG. 11, the amount of the phase shift at the center frequency $f_0$ is still maintained at 90° even if the open stub is added, and only the slope of the phase shift-frequency relationship is corrected to approximately 0. The phase shift deviation is reduced to almost 0 in a wide frequency range, thereby a wide usable frequency range (bandwidth) of the phase shifter is realized.

Figure 4:
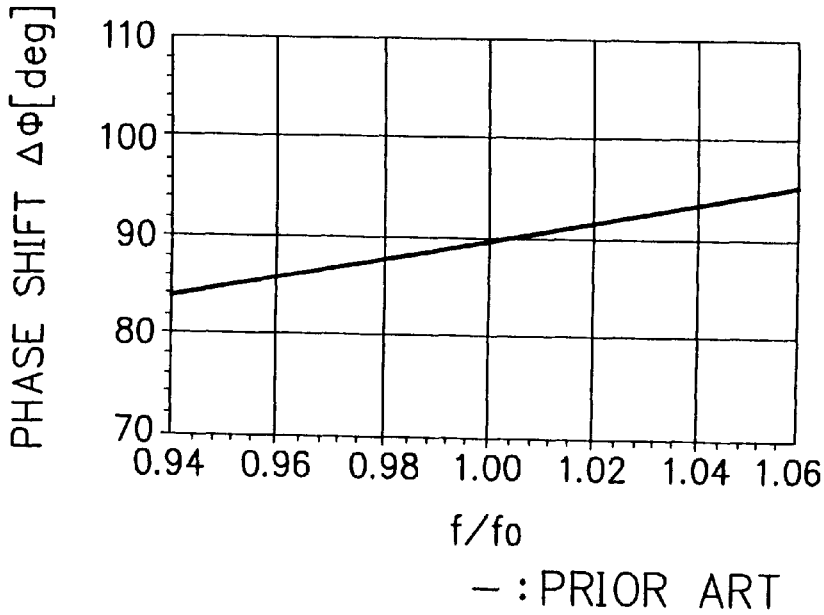
FIG. 4 (PRIOR ART)
FIG. 4 is a graph showing the phase shift deviation (phase shift-frequency relationship) of the conventional 90° switched line phase shifter of FIGS. 2 and 3.

Incidentally, the phase shift at the center frequency $f_0$ could be set exactly to 90° in FIG. 11 because FIG. 11 showed the phase shift-frequency relationship when the open stub length is a multiple of $\lambda g_0/2$ (that is, addition of the phase shift-frequency relationship of the conventional switched line phase shifter shown in FIG. 4 (phase shift at the center frequency $f_0$:90°) and the transmission phase characteristics of the open stub shown in FIG. 8 (transmission phase delay at the center frequency $f_0$: 0°)).

On the other hand, when the open stub length is not a multiple of $\lambda g_0/2$, the transmission phase delay at the center frequency $f_0$ deviates from 0 as shown in FIG. 7 and thereby the phase shift of the phase shifter at the center frequency $f_0$ 90° (i.e. designed phase shift of the phase shifter) shifts from 90° . In addition, although not shown in figures, mismatch occurs due to the addition of the open stub (whose length is not a multiple of $\lambda g_0/2$) and the reflection characteristics are deteriorated. However, if the transmission phase delay change at the center frequency $f_0$ due to the addition of the open stub is preliminarily grasped and the transmission phase delay change is taken into consideration in the designing of the phase shifter, a desired overall phase shift characteristics can be obtained. The deterioration of the reflection characteristics can also be eliminated by providing an additional matching circuit.

As described above, in the phase shifter in accordance with the first embodiment of the present invention, at least one of the switched lines of the conventional switched line phase shifter is directly (always) connected to a main line so as to operate as an open stub in the state S, thereby the phase shift deviation can be reduced and the phase shift-frequency relationship can be improved. In addition, the number of the RF switches can be reduced in comparison with the conventional switched line phase shifter.

Figure 12:
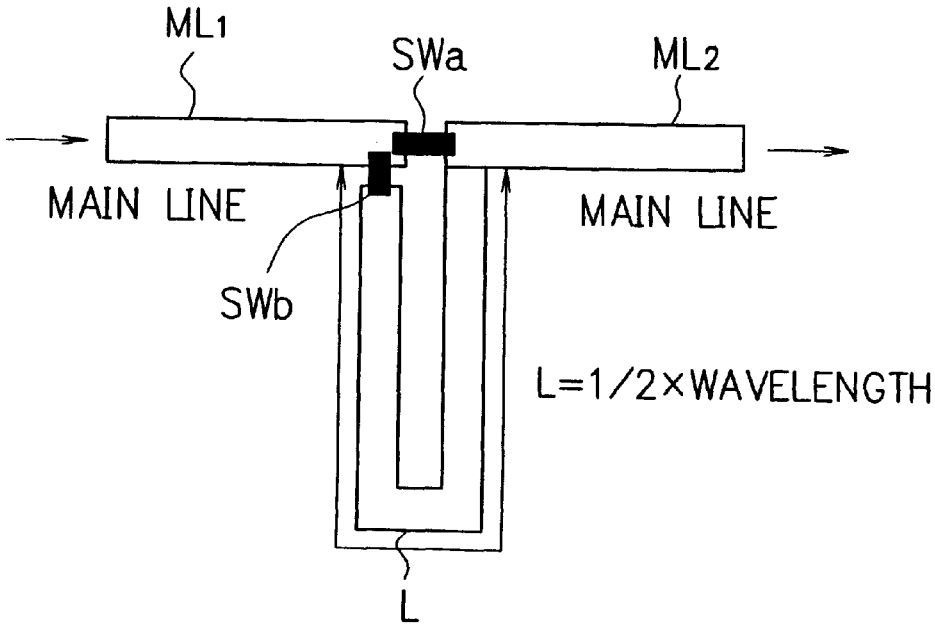
FIG. 12 is a plan view showing a phase shifter in accordance with a second embodiment of the present invention.

FIG. 12 is a plan view showing a phase shifter in accordance with a second embodiment of the present invention. The phase shifter shown in FIG. 12 is a 180° phase shifter which is implemented by setting the switched line lengths L and S of the phase shifter of FIG. 5 as $L=\lambda g_0/2$ and S=0. The phase shifter of FIG. 12, which does not have the switched line S, can be implemented by use of only two RF switches, therefore, the number of the RF switches can be reduced by 2 in comparison with the conventional switched line phase shifter of FIG. 1. The RF switches SWa and SWb operate together similarly to the first embodiment. When the RF switches SWa and SWb are (OFF, ON), the switched line L is connected to the main lines $ML_1$ and $ML_2$ (hereafter referred to as "state L"). When the RF switches SWa and SWb are (ON, OFF), the main lines $ML_1$ and $ML_2$ are directly connected (hereafter referred to as "state S"). Even in the state S, the right-hand end of the switched line L is still connected to the main line $ML_2$. The switched line L in the state S operates as an open stub and thereby the phase shift-frequency relationship is improved.

Figure 13:
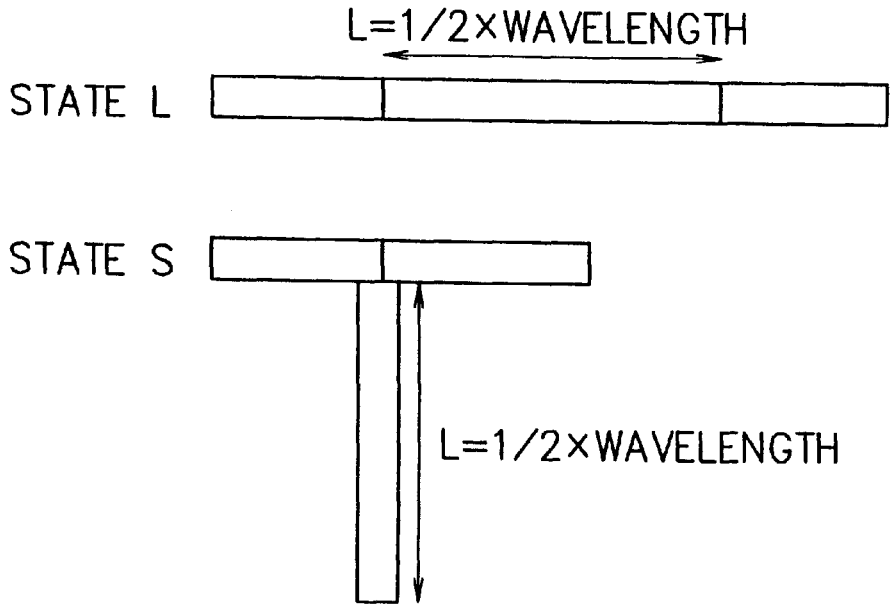
FIG. 13 is an explanatory drawing which explains the operation of the 180° phase shifter of FIG. 12 simply.

FIG. 13 is an explanatory drawing which explains the operation of the 180° phase shifter of FIG. 12 simply. FIGS. 12 and 13 are equivalent in electrical meanings. By the switching of the RF switches SWa and SWb between the states L and S, a phase shift corresponding to the length difference $\lambda g_0/2$ (that is, $\Delta\Phi=180°$ ) is realized. In the state S, the switched line L, whose right-hand end is directly connected to the main line $ML_2$, operates as the open stub. The open stub length (the length of the switched line L) is $\lambda g_0/2$ (a multiple of $\lambda g_0/2$), therefore, the ill effects of the connection of the open stub on the transmission phase delay and matching are avoided. The open stub of the phase shifter of the second embodiment improves the phase shift-frequency relationship in the same way as the open stub in the first embodiment which has been shown in FIG. 9.

Figure 14:
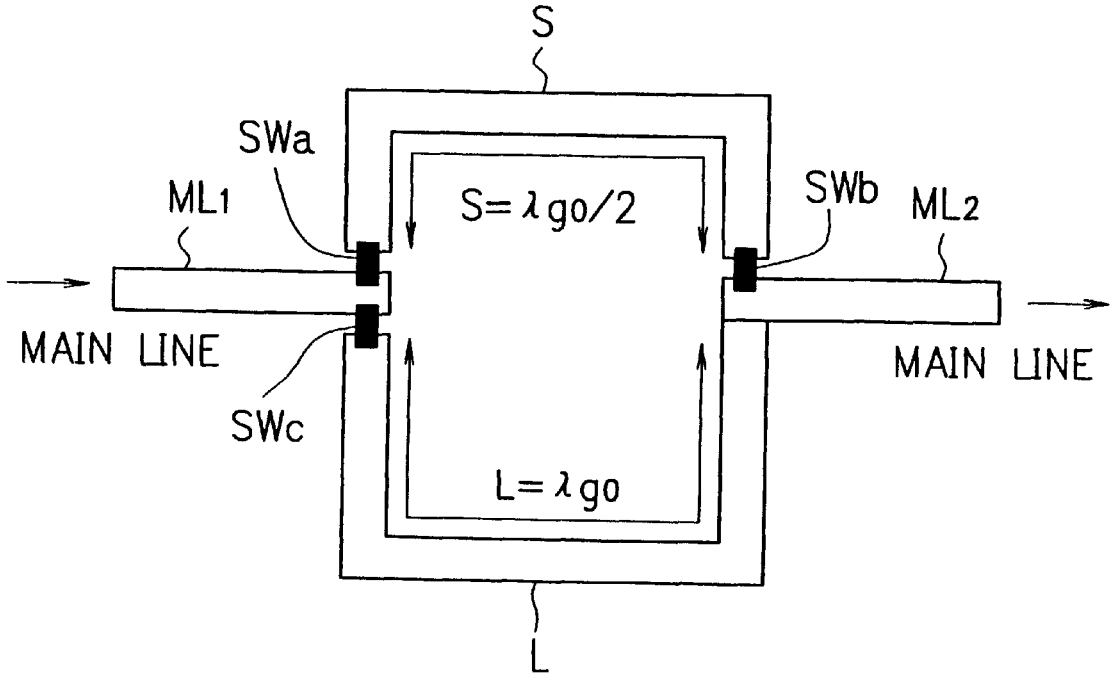
FIG. 14 is a plan view showing a phase shifter in accordance with a third embodiment of the present invention.

FIG. 14 is a plan view showing a phase shifter in accordance with a third embodiment of the present invention. The phase shifter shown in FIG. 14 is a 180° phase shifter which is implemented by setting the switched line lengths L and S of the phase shifter of FIG. 5 as $L=\lambda g_0$ and $S=\lambda g_0/2$. The phase shifter of FIG. 14 can be implemented by use of three RF switches, therefore, the number of the RF switches can be reduced by 1 in comparison with the conventional switched line phase shifter of FIG. 1. The RF switches SWa~SWc operate together. When the RF switches SWa~SWc are (OFF, OFF, ON), the switched line L is connected to the main line $ML_1$ (and the main line $ML_2$ ) and the switched line S is disconnected from the main lines $ML_1$ and $ML_2$ (hereafter referred to as "state L"). When the RF switches SWa~SWc are (ON, ON, OFF), the switched line S is connected with the main lines $ML_1$ and $ML_2$ (hereafter referred to as "state S"). Even in the state S, the right-hand end of the switched line L is still connected to the main line $ML_2$. The switched line L in the state S operates as an open stub and thereby the phase shift-frequency relationship is improved.

Figure 15:
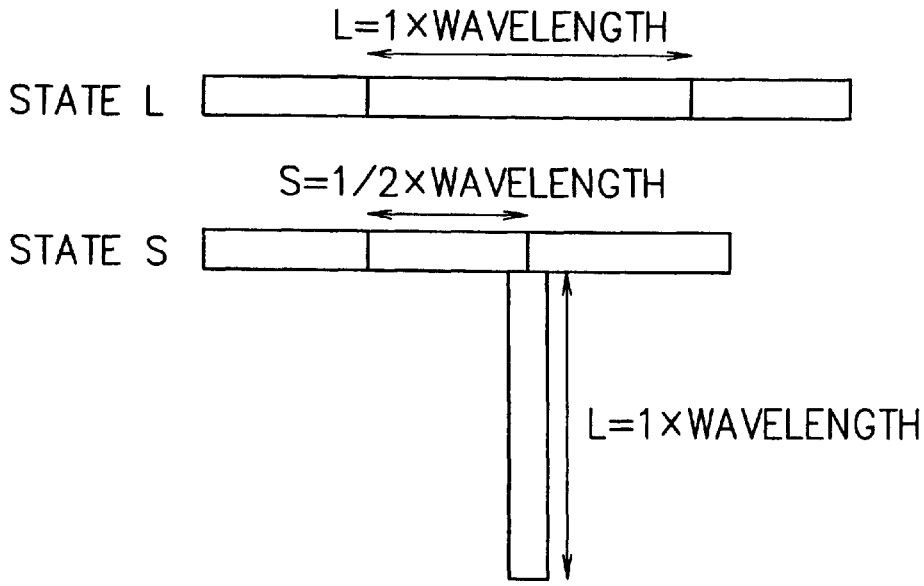
FIG. 15 is an explanatory drawing which explains the operation of the 180° phase shifter of FIG. 14 simply.

FIG. 15 is an explanatory drawing which explains the operation of the 180° phase shifter of FIG. 14 simply. FIGS. 14 and 15 are equivalent in electrical meanings. By the switching of the RF switches SWa SWc between the states L and S, a phase shift corresponding to the length difference $(L-S)=\lambda g_0/2$ (that is, $\Delta\Phi=180°$) is realized. In the state S, the switched line L, whose right-hand end is directly connected to the main line $ML_2$, operates as the open stub. The open stub length (the length of the switched line L) is $\lambda g_0$ (a multiple of $\lambda g_0/2$), therefore, the ill effects of the connection of the open stub on the transmission phase delay and matching are avoided. The open stub of the phase shifter of the third embodiment improves the phase shift-frequency relationship in the same way as the open stub in the first embodiment which has been shown in FIG. 9.

Figure 16:
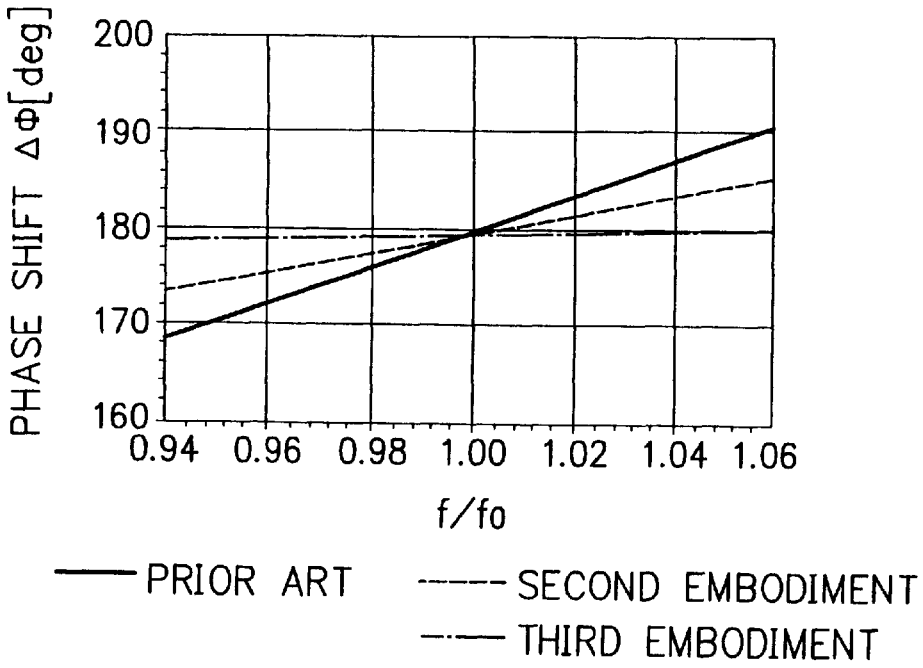
FIG. 16 is a graph showing simulation results of the phase shift-frequency relationships of the 180° phase shifters of the FIG. 12 (second embodiment) and FIG. 14 (third embodiment)

FIG. 16 is a graph showing simulation results of the phase shift-frequency relationships of the 180° phase shifters of the FIG. 12 (second embodiment) and FIG. 14 (third embodiment), in which the result for the conventional switched line phase shifter is also shown. As shown in FIG. 16, the phase shift at the center frequency f is maintained at 180° and only the slope of the phase shift-frequency relationship is corrected in both embodiments, since the open stub lengths in the embodiments are multiples of $\lambda g_0/2$. In the case of the third embodiment (FIG. 14), the slope of the phase shift-frequency relationship becomes almost 0 in a wide frequency range, thereby a wide usable frequency range (bandwidth) of the phase shifter is realized.

However, in the case of the second embodiment (FIG. 12), the slope of the phase shift-frequency relationship can not be corrected perfectly, since the length of the open stub which is connected to the main line $ML_2$ in the state S is not appropriate. Concretely, as is clear from FIG. 11, an open stub length of $\lambda g_0/2$ is necessary for the correction of the slope of the phase shift-frequency relationship of the 90° phase shifter. Therefore, for the correction of the slope of the phase shift-frequency relationship of the 180° phase shifter, an open stub of a length of $\lambda g_0$ becomes necessary. Therefore, the slope correction can be done perfectly in the case of FIG. 14 (third embodiment) and can not be done in the case of FIG. 12 (second embodiment). Although the slope correction can not be done perfectly in the case of FIG. 12 (second embodiment), the number of the RF switches (2) can be made smaller in the second embodiment and thus is more advantageous in comparison with FIG. 14 (third embodiment) where miniaturization is concerned.

Figure 17:
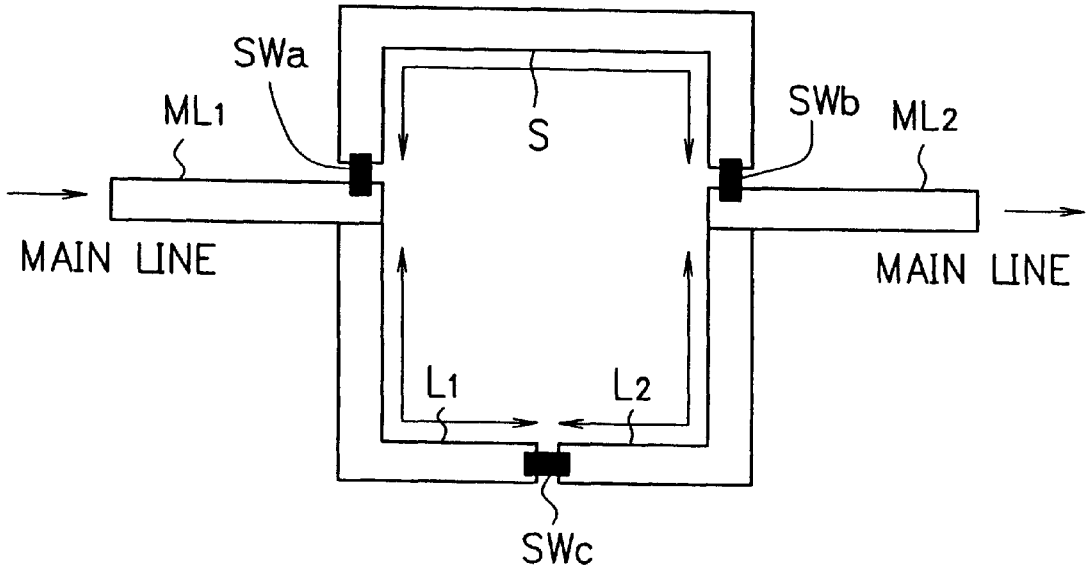
FIG. 17 is a plan view showing a phase shifter in accordance with a fourth embodiment of the present invention.
Figure 18:
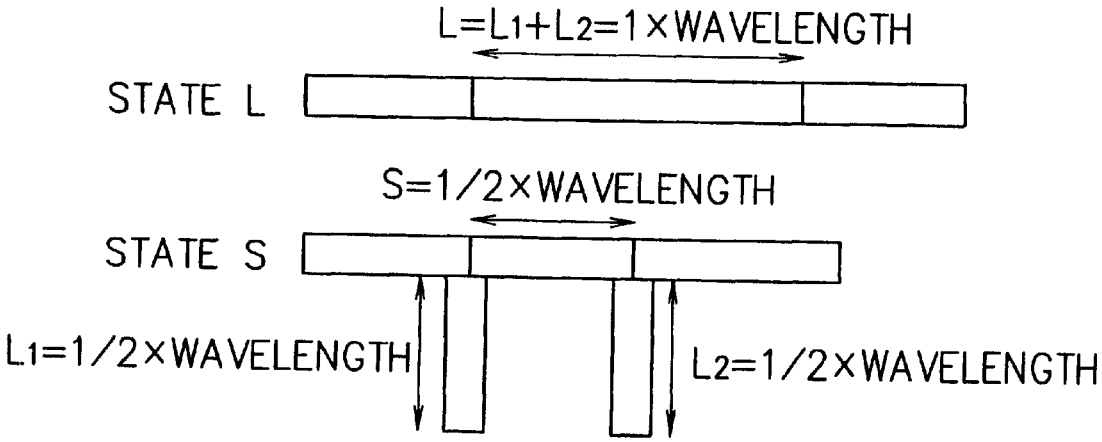
FIG. 18 is an explanatory drawing which explains the operation of the 180° phase shifter of FIG. 17 simply.

FIG. 17 is a plan view showing a phase shifter in accordance with a fourth embodiment of the present invention. The phase shifter shown in FIG. 17 is a 180° phase shifter in which two open stubs are connected to the main lines in the state S. In the phase shifter of FIG. 17, the RF switch SWc is placed on the switched line L so that the switched line L will be segmented into two switched lines $L_1$ and $L_2$. FIG. 18 is an explanatory drawing which explains the operation of the 180° phase shifter of FIG. 17 simply, in which the switched line lengths are assumed to be $S=L_1=L_2=\lambda g_0/2$. The phase shifter of FIG. 17 can be implemented by use of three RF switches, therefore, the number of the RF switches can be reduced by 1 in comparison with the conventional switched line phase shifter of FIG. 1. The RF switches SWa~SWc operate together. When the RF switches SWa~SWc are (OFF, OFF, ON), the switched lines $L_1$and $L_2$, which are directly connected to the main lines $ML_1$ and $ML_2$ respectively, are connected together and the switched line S is disconnected from the main lines $ML_1$ and $ML_2$ (hereafter referred to as "state L"). When the RF switches SWa~SWc are (ON, ON, OFF), the switched line S is connected with the main lines $ML_1$ and $ML_2$ and the connection between the switched lines $L_1$ and $L_2$ is disconnected (hereafter referred to as "state S"). In the state S, each switched line ($L_1$, $L_2$) is connected to a main line ($ML_1$ , $ML_2$) by its one end only, and the two switched lines $L_1$ and $L_2$ are connected to the transmission line in the shape of"π".

By the switching of the RF switches SWa~SWc between the states L and S, a phase shift corresponding to the length difference $(L-S)=\lambda g_0/2$ (that is, $\Delta\Phi=180°$ ) is realized. In the state S, each switched line ($L_1$, $L_2$) is connected to a main line ($ML_1$ , $ML_2$) and operates as an open stub. The open stub lengths (the lengths of the switched lines $L_1$ and $L_2$) are $\lambda g_0/2$ (multiples of $\lambda g_0/2$), therefore, the ill effects of the connection of the open stubs on the transmission phase delay and matching are avoided. The two open stubs (open stub lengths: $\lambda g_0/2$) improves the phase shift-frequency relationship.

Figure 19:
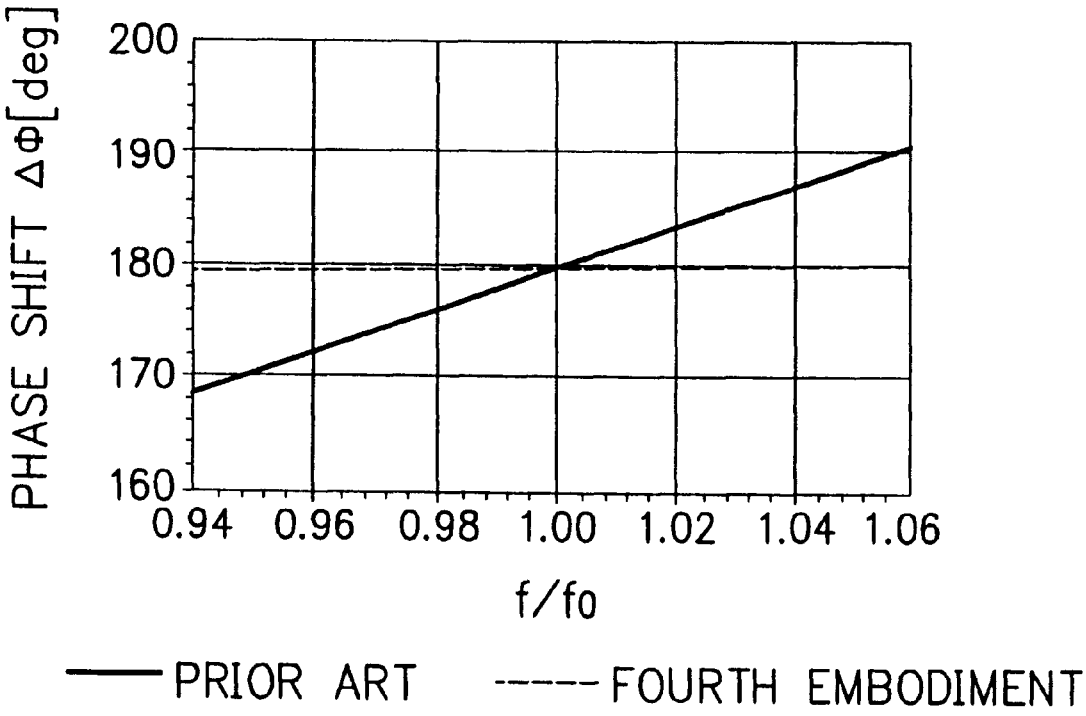
FIG. 19 is a graph showing a simulation result of the phase shift-frequency relationship of the 180° phase shifter of FIG. 17.
Figure 20:
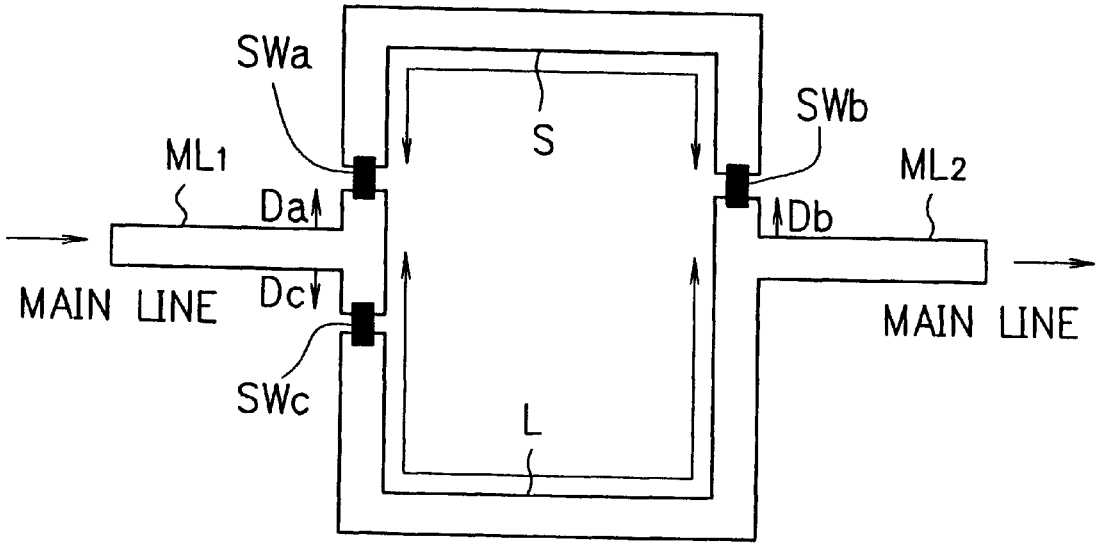
FIGS. 20 through 23 are plan views showing phase shifters in accordance with a fifth embodiment of the present invention, in which RF switches are installed in positions withdrawn from main lines.
Figure 21:
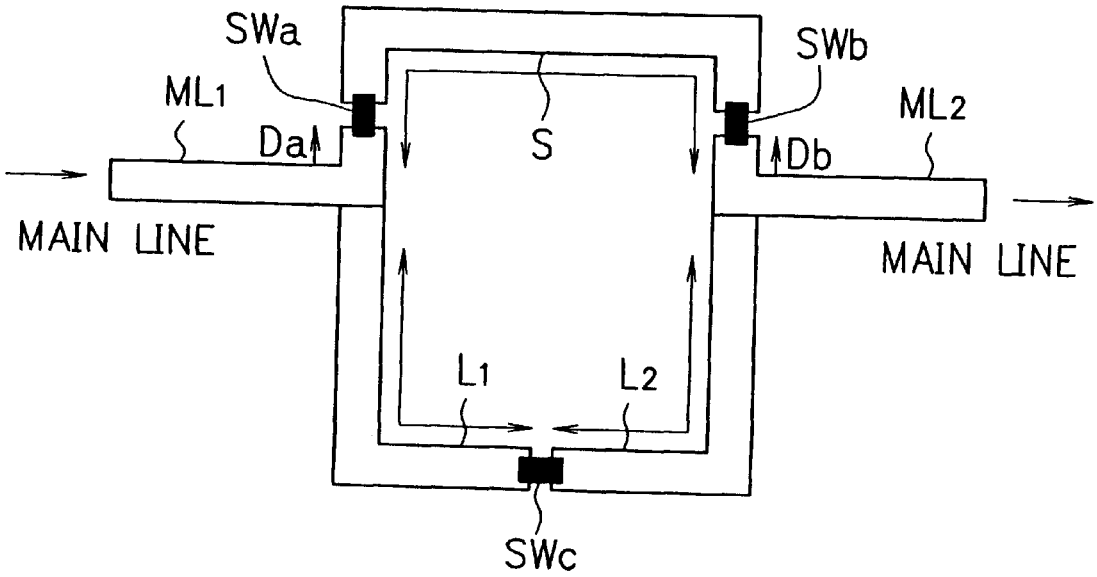
Figure 22:
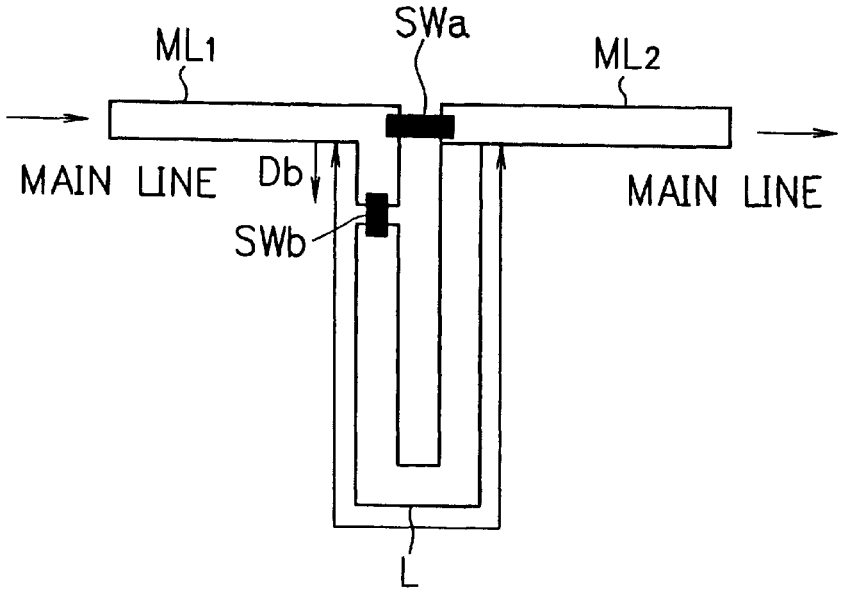
Figure 23:
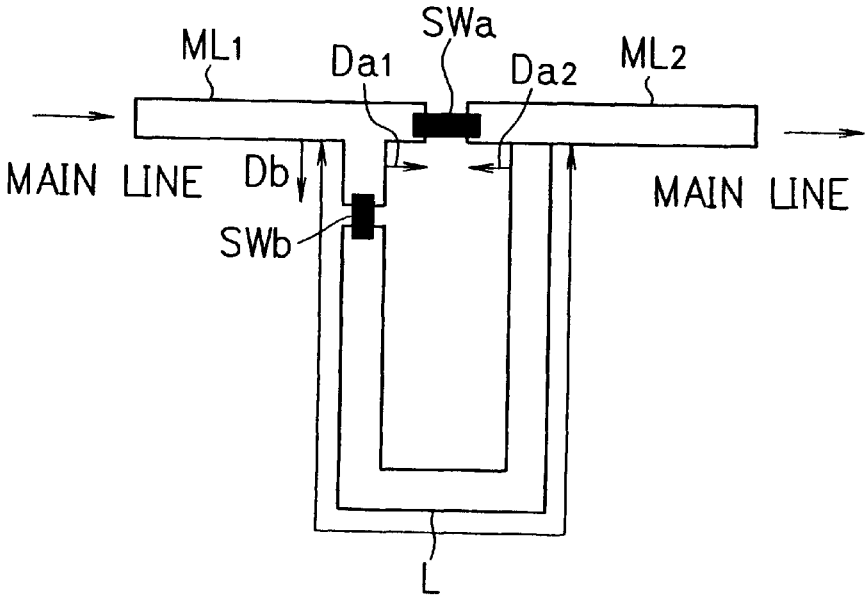

FIG. 19 is a graph showing a simulation result of the phase shift-frequency relationship of the 180° phase shifter of FIG. 17, in which the result for the conventional switched line phase shifter is also shown. As shown in FIG. 19, the slope of the phase shift-frequency relationship is almost perfectly corrected by the two open stubs (open stub lengths: $\lambda g_0/2$) which are connected to the main lines $ML_1$ and $ML_2$ in the state S.

While the RF switches SWa, SWb and SWc in the above embodiments (in the fourth embodiment, RF switches SWa and SWb) were directly installed at the ends of the main lines $ML_1$ and $ML_2$, there are cases where such installation becomes difficult by reason of the size of the RF switches etc. In such cases, the RF switches may be placed in positions withdrawn from the main lines (withdrawing distance: Da, Db, Dc, $Da_1$, $Da_2$) as shown in FIGS. 20 through 23. The withdrawing distances may be set appropriately depending on the RF switches which are actually installed. In such composition employing the withdrawn installation of the RF switches, the switched line lengths change and the open stub length becomes shorter, therefore, the resultant phase shift deviates from the designed phase shift and the reflection characteristics are deteriorated due to mismatch owing to the open stub. However, if the deviation of the phase shift at the center frequency $f_0$ is preliminarily grasped and is taken into consideration in the designing of the phase shifter, a desired overall phase shift characteristics can be obtained. The deterioration of the reflection characteristics can also be eliminated by providing an additional matching circuit depending on cases.

Incidentally, while the main lines $ML_1$ and $ML_2$ and the switched lines S and L of the phase shifters of the above embodiments have been assumed to be implemented by microstrip lines on circuit boards, arbitrary types of transmission lines such as slot lines, co-planer lines, coaxial lines, etc. can also be used as mentioned before.

As set forth hereinabove, in the phase shifters in accordance with the present invention, at least one of the switched lines of the conventional switched line phase shifter is directly (always) connected to a main line and an open stub is implemented, thereby the phase shifter deviation can be reduced and the phase shift-frequency relationship can be improved. According to the present invention, the number of necessary switches can also be reduced by one or two in comparison with the conventional switched line phase shifter.

While the present invention has been described with reference to the particular illustrative embodiments, it is not to be restricted by those embodiments but only by the appended claims. For example, the number of the switched lines is not limited to two, but three or more switched lines (two or more delay lines) can also be employed depending on design requirements of the phase shifter. It is to be appreciated that those skilled in the art can change or modify the embodiments without departing from the scope and spirit of the present invention.

What is claimed is:

1. A digital phase shifter without signal gain that shifts a phase of an inputted radio frequency (RF) signal by connecting an input main line to an output main line, such that, at least one switched line, which is selectively connected or disconnected to the input main line at one end, is always connected to the output main line at another end and operates as a single open stub to reduce a phase shift deviation across an input RF range, when the inputted RF signal is not passed through the at least one switched line.

2. A digital radio frequency (RF) phase shifter without signal gain that reduces a phase shift deviation, which varies with an input RF signal frequency, the phase shifter, comprising:

a first main line that receives an input RF signal;

a second main line that transmits an output RF signal and, which is placed a predetermined distance apart from the first main line;

a switched line, which is placed between the first main line and the second main line, is always connected to the second main line, and has a phase shift frequency relationship with a negative slope;

a first switch that at least one of connects and disconnects the first main line and the second main line; and a second switch that at least one of connects and disconnects the first main line and the switched line, wherein when the first switch connects the first main line and the second main line and the second switch disconnects the first main line and the switched line, the switched line operates as a single open stub to reduce the phase shift deviation.

3. A phase shifter as claimed in claim 2, wherein at least one of the first main line, the second main line, and the switched line comprises a microstrip line.

4. A phase shifter as claimed in claim 2, wherein at least one of the first main line, the second main line, and the switched line comprises a slot line.

5. A phase shifter as claimed in claim 2, wherein at least one of the first main line, the second main line, and the switched line comprises a co-planar line.

6. A phase shifter as claimed in claim 2, wherein at lest one of the first main line, the second main line, and the switched line comprises a coaxial line.

7. A phase shifter as claimed in claim 2, wherein at least one of the from switch and the second switch comprises a PIN diode.

8. A phase shifter as claimed in claim 2, wherein at least one of the first switch and the second switch comprises an FET (Field Effect Transistor).

9. A phase shifter as claimed in claim 2, wherein at least one of the first switch and the second switch comprises a mechanical relay.

10. A phase shifter as claimed in claim 2, wherein at least one of the first switch and the second switch comprises a micromachine switch.

11. A digital radio frequency (RF) phase shifter without signal gain that reduces a phase shift deviation, which varies with an input RF signal frequency, the phase shifter, comprising:

a first main line that receives an input RF signal;

a second main line that transmits an output RF signal and, which is placed a predetermined distance apart from the first main line;

a switched line, which is placed between the first main line and the second main line, is always connected to the second main line, and has a phase shift frequency relationship with a negative slope;

a first switch that selectively connects or disconnects the first main line and the second main line; and a second switch that selectively connects or disconnects the first main line and the switched line, wherein when the first switch connects the first main line and the second main line and the second switch disconnects the first main line and the switched line, the switched line operates as a single open stub to reduce the phase shift deviation.

12. A phase shifter as claimed in claim 11, wherein a length of the switched line is a multiple of ½ the wavelength of the input RF signal, thereby implementing a 180° phase shift.

* * * * *